US011002109B1

(12) United States Patent
Tseytlin

(10) Patent No.: US 11,002,109 B1
(45) Date of Patent: May 11, 2021

(54) METHODS AND DEVICES FOR MAXIMIZING OIL PRODUCTION FOR WELLS CONTAINING OIL WITH HIGH GAS-TO-OIL RATIO AND OIL EXTRACTION FROM OIL RIMS OF GAS RESERVOIRS

(71) Applicant: Simon Tseytlin, Middle Village, NY (US)

(72) Inventor: Simon Tseytlin, Middle Village, NY (US)

( * ) Notice: Subject to any disclaimer, the term of this patent is extended or adjusted under 35 U.S.C. 154(b) by 0 days.

(21) Appl. No.: 16/739,240

(22) Filed: Jan. 10, 2020

(51) Int. Cl.

| | |
|---|---|
| ***E21B 17/04*** | (2006.01) |
| ***E21B 17/14*** | (2006.01) |
| ***E21B 34/12*** | (2006.01) |
| ***E21B 43/32*** | (2006.01) |
| ***E21B 34/16*** | (2006.01) |

(52) U.S. Cl.
CPC ..... *E21B 34/16* (2013.01); *E21B 17/04* (2013.01); *E21B 34/12* (2013.01); *E21B 43/32* (2013.01); *E21B 2200/06* (2020.05)

(58) Field of Classification Search
CPC ..... E21B 17/04; E21B 17/041; E21B 17/14; E21B 34/12; E21B 43/32
See application file for complete search history.

(56) References Cited

U.S. PATENT DOCUMENTS

| | | | | |
|---|---|---|---|---|
| 2,999,540 | A * | 9/1961 | Bodine, Jr. | E21B 43/003 166/302 |
| 3,825,071 | A * | 7/1974 | Veatch, Jr. | E21B 43/26 166/308.1 |
| 2012/0292032 | A1 * | 11/2012 | Themig | E21B 34/12 166/310 |

* cited by examiner

*Primary Examiner* — Cathleen R Hutchins
(74) *Attorney, Agent, or Firm* — Boris Leschinsky

(57) ABSTRACT

A novel passive flow restrictor attached outside the tubing in an oil well and positioned below casing perforations, causing fluid flow from an oil reservoir formation to at least partially flow through a narrow annular space between the flow restrictor and the casing before entering the tubing. The flow resistance is thereby defined in part by the length of the annular space, which is easily adjusted by lowering or raising the tubing within the casing. The flow restrictor and methods of using thereof are especially advantageous for maximizing oil production in thin oil rim gas reservoir as well as with other oil wells with high Gas-to-Oil Ratio.

8 Claims, 8 Drawing Sheets

METHODS AND DEVICES FOR MAXIMIZING OIL PRODUCTION FOR WELLS CONTAINING OIL WITH HIGH GAS-TO-OIL RATIO AND OIL EXTRACTION FROM OIL RIMS OF GAS RESERVOIRS

BACKGROUND

Without limiting the scope of the invention, its background is described in connection with oil production. More particularly, the invention describes methods, computer models, and related devices allowing simplified adjustment of bottomhole pressure in order to obtain the highest possible oil production for an oil well with a high gas-to-oil ratio over the lifetime of the oil well. The invention has particular utility in thin oil rims of gas reservoirs.

In order for oil production to keep up with the ever-growing energy demand, it is essential to find new ways to improve the recovery of existing oil fields. The most advantageous implementation of the present invention is in wells with high Gas-to-Oil Ratio (GOR) defined as GOR greater than about 100 cubic meters of gas over cubic meters of oil, which is sometimes also referred to in other units as about 600 cubic feet of gas per barrel of oil, which is the same as above. Such oil wells may exhibit high and increasing production of gas accompanied by low and decreasing production of oil. In extreme cases, a gas flow regime may be formed with no oil exiting the oil well altogether—even despite adjustments of the surface choke, including either closing or opening thereof. At some point, the gas flow regime may exhaust the reservoir formation pressure and preclude any further oil production, whereby severely limiting a total oil recovery from a particular oil well and even from a particular reservoir formation.

Significant oil reserves are captured in relatively thin oil rims sandwiched between overlying gas and underlying condensate or water. Due to a strong tendency for gas cone formation leading to early gas or water breakthrough in these wells, efficient production from these fields has always been a real technological challenge. It continues to be difficult, despite the advancements in the hardware technology over the last decade, in particular, the ability to install and use sensors and remotely controllable valves in both wells and at the surface. Apart from the natural technical constraints of poor accessibility of large portions of the reservoir in terms of both control and monitoring, the other main factor contributing to this is the fact that the optimization of wells using the flow control devices is still not adequate for maximizing oil production. New technologies are needed to allow efficient oil recovery in thin oil rims of gas reservoirs.

This invention contains further improvements of my earlier U.S. Pat. Nos. 7,172,020; 7,753,127; and 10,435,983 incorporated herein in their respective entireties by reference.

A conventional oil well is illustrated in FIG. 1 and includes an oil/gas reservoir formation 1, which is reached by an oil well casing 6 with a plurality of perforations 2 allowing oil to enter the internal space of the casing 6. An oil well tubing 7 is lowered into the casing 6 and concentrically fixed at the bottomhole region by spacers/packers 4 or other suitable means. The oil well tubing 7 extends to the surface of the well and features an adjustable surface choke 8 used to control the flow of oil and gas from the oil well tubing 7.

Optimization of oil production and an increase in ultimate oil recovery from an oil well has been a goal of many innovative methods and devices of the prior art. Generally speaking, the bottomhole behavior of oil mixed with gas (and some other ingredients such as water, etc.) has been described in a series of mathematical equations by Musket. One specific publication by Musket is incorporated herein by reference in its entirety and describes the mathematical model of oil reservoir: Musket M. "The Production Histories of Oil Producing Gas-Drive Reservoirs", published in the Journal of Applied Physics in March of 1945, p. 147-159.

For illustration purposes, a unidimensional axisymmetric system of Musket equations with corresponding PVT characteristics of fluid and dependencies of relative permeability $K_{ro}$, $K_{rg}$ from liquid saturation ($S_o$) can be described as follows:

$$\frac{1}{r}\frac{\partial}{\partial r}\left(r\frac{k_{ro}}{\mu_0 B_o}\frac{\partial p}{\partial r}\right) = -158.064\frac{\phi}{k}\frac{\partial}{\partial t}\left(\frac{S_o}{B_o}\right) \tag{1}$$

$$\frac{1}{r}\frac{\partial}{\partial r}\left[r\left(\frac{k_{rg}}{\mu_g B_g} + \frac{Rs}{5.615}\frac{k_{ro}}{\mu_o B_o}\right)\frac{\partial p}{\partial r}\right] = -158.064\frac{\phi}{k}\frac{\partial}{\partial t}\left(\frac{S_g}{B_g} + \frac{S_o}{B_o}\frac{Rs}{5.615}\right)$$

where: P—pressure in formation; $S_o$—oil saturation in formation; $S_g$—gas saturation in formation; $R_s$—solution of gas in oil; $B_o$—oil formation volume factor; $B_g$—gas formation volume factor; $\mu_o$—oil viscosity; $\mu_g$—gas viscosity; φ μformation porosity; K—formation permeability.

For practical purposes, Vogel had simplified the Musket equations and adapted them to the calculations of oil-producing formations. These equations are known as Vogel model and have subsequently been modified by others. One example of such publication is as follows: Vogel, *Inflow Performance Relationships for Solution-Gas Drive Wells*, as published in Journal of Petroleum Technology, January 1968, pp. 83-92, incorporated herein in its entirety by reference. Unfortunately, Vogel model does not work well in wells with a high gas-to-oil ratio. According to Vogel, the dependency of oil rate production of bottomhole pressure is a constantly diminishing parabolic curve with a production peak at zero value of the bottomhole pressure, see for example FIG. 2 of the above-mentioned article. In other words, the lower the bottomhole pressure, the higher the oil rate production from the formation. This is a gross simplification of the bottomhole processes in the formation. In fact, if the bottomhole pressure falls below saturation pressure in case of high GOR, relative permeability coefficient by oil decreases because of gas saturation increase, which in turn is a result of gas being released from oil. Viscosity of so degassed oil also increases. This leads to a decrease in productivity index of formation. This phenomenon affects the oil production rate more than increasing depression. As a result, decreasing the bottomhole pressure below saturation pressure can lead to a decrease in oil production rate, rather than to its increase as predicted by Vogel's model, see FIG. 2. In some extreme cases, reliance on Vogel's model will cause a complete switch in production from oil to gas.

It is also known that producing oil wells with high GOR (Gas-to-Oil Ratio) often lose their stability, and this process is accompanied by a sharp increase in GOR. Any attempts to stop this process by using a surface choke or other surface manipulations usually fail, and the oil well gradually switches into a full gas production mode. The physics of this process can be explained as follows: in a case when a gas cone covers some holes of a perforated section of the well casing 6, quite often that oil well loses stability. This, in turn, leads to a continuing slow increase of the cone height followed by an increase in the gas stream and a decrease in the oil flow. This process continues until the well is completely switched to a gas mode. Even if a switch to a gas mode does not happen, the instability of the well does not allow efficient control of the bottomhole pressure by using a choke at the surface. Similar detrimental phenomena can occur because of formation of a gas skin effect near the bottom of the well. The physics of the skin effect is described in detail in my U.S. Pat. No. 7,172,020. It also shows that this phenomenon leads to a non-conventional shape of the IPR curve (Inflow Pressure Relationship, i.e. the dependence of well oil flow rate of the bottomhole pressure). A notable feature of this curve is the presence of a certain threshold value of the bottomhole pressure (called "$P_{opt}$—optimal pressure"), at which the greatest possible oil flow rate from a reservoir can be achieved (FIG. 2).

The process of gas cone formation interrupting the flow of oil from the well is especially difficult to control in thin oil rims gas reservoirs where the height of the oil layer may only be several meters. The fluctuation of gas and oil flows entering the fixed geometry perforations of the casing cause disruption of oil recovery and in many cases preclude substantial amounts of oil from being extracted from the oil well altogether.

A new understanding of the processes surrounding any deviation of the oil production from the initial optimal level is described in my previous patents referenced above. Reference is made now to FIG. 3 showing an exemplary calculated IPR curve superimposed onto a GOR (Gas-to-Oil Ratio) curve in a space defined by bottomhole pressure and the oil flow rate coordinates. As the oil production rate increases with decreasing of the bottomhole pressure following an IPR curve from the top point corresponding to the reservoir formation pressure, it reaches a maximum level of oil production at the point marked with an arrow. All throughout that process, the GOR value remains at or about the initial level and not changing much as the bottomhole pressure reaches the optimal level, as the GOR curve is essentially close to a vertical line in that region of the chart. From the point of reaching the maximum oil production rate and further below thereof, however, as the bottomhole pressure and the oil rate continue to decrease, the GOR curve exhibits a sharp increase at the bottom right corner of the chart, indicating a rapidly increasing amount of gas entering the oil well.

As the bottomhole pressure decreases and the GOR raises to a higher level, the flow restrictor causes the flow regime in at least one of the first stage or a second stage to change from a bubble type two-phase flow to a slug type two-phase flow. The increase in the amount of gas traversing the flow restrictor of appropriate size is causing a rapid increase in its flow resistance, which in turn causes the increase in the bottomhole pressure and therefore urging the oil production rate to shift back up in the direction of the maximum oil production rate. This, in turn, causes the GOR to decrease again to get closer to its level corresponding to the maximum oil production rate. The gas component of the two-phase flow is therefore decreasing, and the equilibrium is maintained.

This unique behavior is, therefore, assuring the maximum oil production rate to be a stable equilibrium point on the IPR curve, thereby any deviations and changes in reservoir conditions are mitigated by the flow restrictor to maintain the oil rate at a desired maximum production point. Because of this behavior, there is no need to adjust the geometry of the flow restrictor from the surface and no need to interrupt the oil production from the oil well for maintaining the production rate at the desired maximum level.

Still, over the lifetime of the well there may be a need for adjusting the flow restrictor. This is typically accomplished by controlling the mechanism of flow restrictor adjustment from the top of the well or by replacing one flow restrictor with another. Both processes are complicated and, in many situations, involve a disruption of oil production from the well.

The need exists therefore for methods and devices for continuously producing oil at a maximum possible rate over the life of the oil well in a stable and predictable manner —including in oil wells in high GOR and even in the presence of gas cone and gas skin effects.

The need also exists for a flow restrictor which is easily controlled from the top of the well without significant disruptions in oil production.

SUMMARY OF THE INVENTION

Accordingly, it is an object of the present invention to overcome these and other drawbacks of the prior art by providing novel methods for maximizing oil recovery from an oil well with high GOR.

It is another object of the present invention to provide methods and devices for maximizing oil production from an oil well without the need to adjust the bottomhole parameters with changing reservoir conditions.

It is a further object of the present invention to provide a mathematical model to determine the optimal level of bottomhole pressure for an oil well producing oil at a maximum rate.

It is yet a further object of the present invention to provide a mathematical model for calculating the optimal level of bottomhole pressure to assure the maximum rate of oil production over the lifetime of the oil well.

It is yet another object of the present invention to provide simplified methods of adjusting the bottomhole pressure without accessing the bottomhole tool located at the lower end of the tubing inside the oil well.

Finally, it is an object of the present invention to provide novel methods of extracting oil from thin oil rims of gas reservoirs.

The present invention provides a novel design of a flow restrictor in which the flow of fluids from the reservoir is directed first to a small annular space between the casing and the tubing so as to force the flow along an elongated narrow annular space where the extent of flow resistance is defined by the length of that narrow annular space. In this case, a simple act of raising or lowering the tubing may be used to adjust the length of the narrow annular flow channel, which in turn leads to a change in flow resistance and bottomhole pressure.

The present invention also provides for novel methods of oil recovery from wells with high GOR, and in particular from thin oil rims of gas reservoirs. According to the method, a flow restrictor as described above is installed at the bottom of the tubing and lowered to a position at or below the gas/oil contact at the bottom of the well. Occasional raising or lowering of the well tubing may be used to finetune the bottomhole pressure so as to at least limit the growth or even totally avoid the formation of the gas cone and maintain oil recovery to a greater extent than with conventional techniques.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through the use of the accompanying drawings, in which:

DETAILED DESCRIPTION OF THE PREFERRED EMBODIMENT OF THE INVENTION

Figure 1:
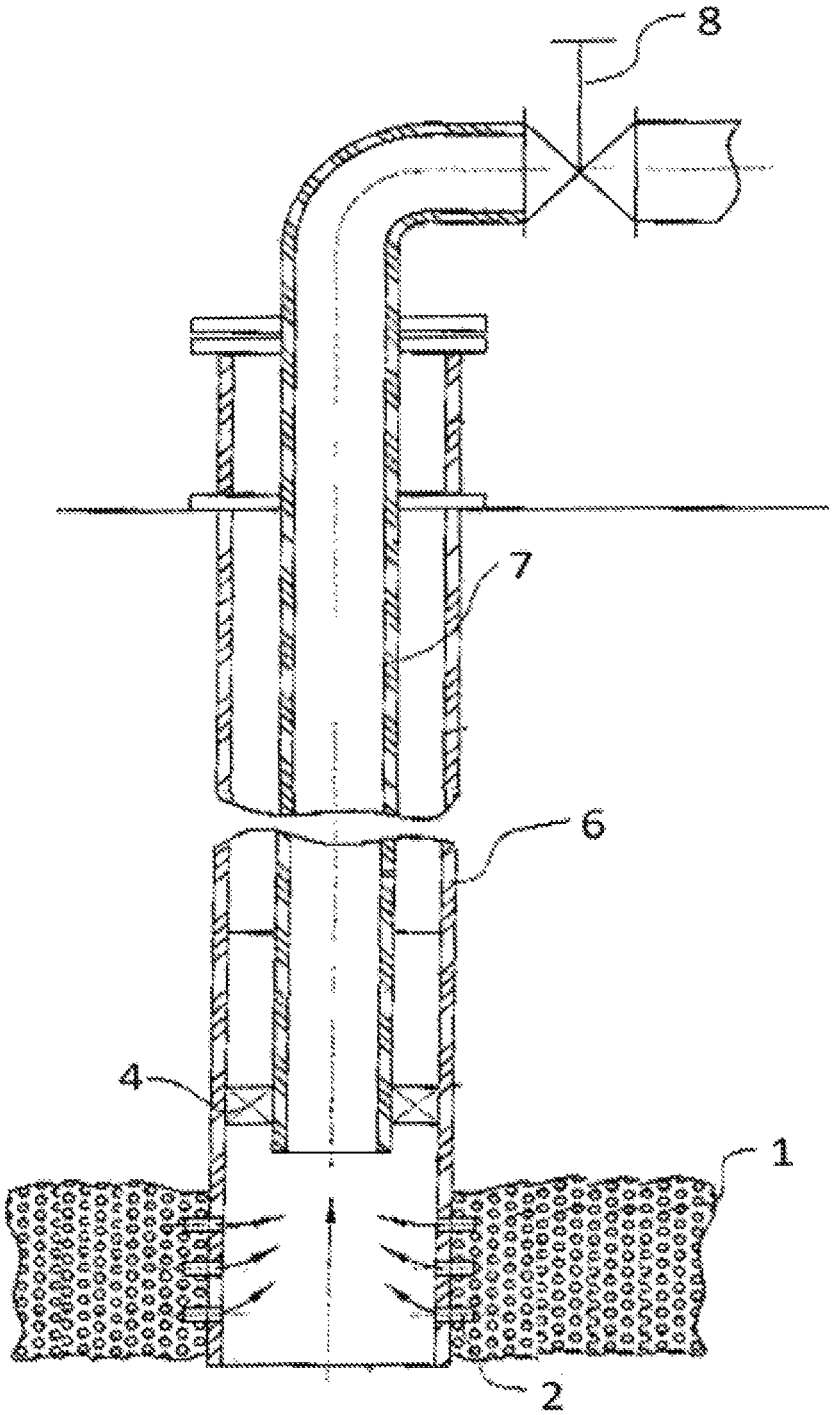
FIG. 1 (PRIOR ART)
FIG. 1 is a general side view of the oil well of the prior art.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 4A:
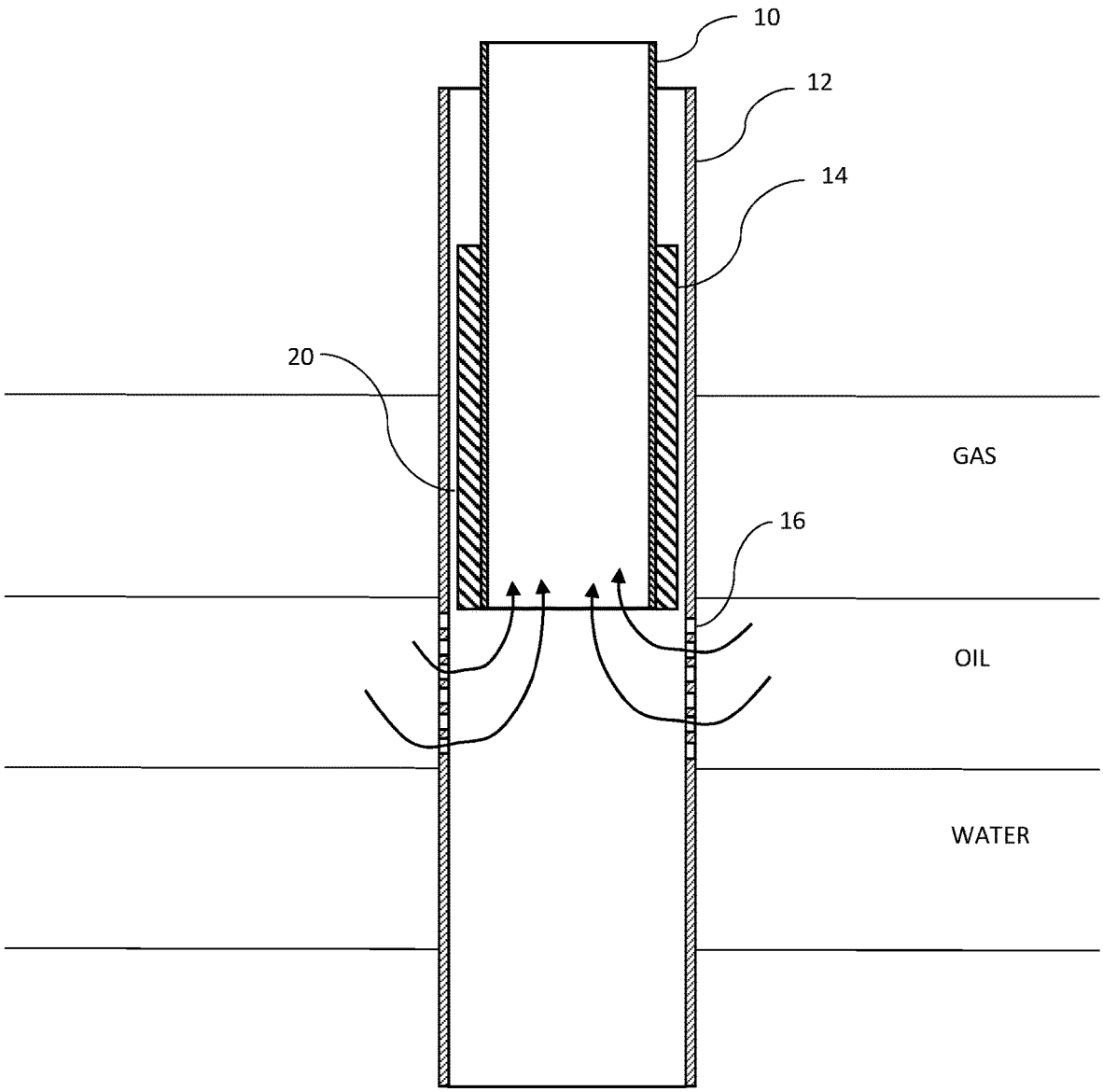
FIG. 4*a* shows a flow restrictor of the present invention in its initial top position in the oil well.

FIG. 4*a* shows a lower portion of the oil well with a casing 12 having a plurality of perforations 16 generally located at the level of the oil layer in the well, which is sandwiched below the gas layer and above the water layer. The upper end of perforations 16 may be positioned at or below the bottom of the gas layer so as to prevent gas from entering the well; the lower end of perforations 16 are generally positioned at or above the water layer so as to prevent water from entering the well also—all this is typically done in order to allow predominantly oil and not gas or water to enter the wellbore so as to maximize oil production from the oil well.

The design for a novel passive (no moving parts of its own) flow restrictor of the invention is shown installed at the lower end of the tubing 10. In its basic form, the flow restrictor 14 may be a coaxial cylinder positioned outside the tubing 10 such that the inner diameter of the cylinder 14 is generally the same as the outer diameter of the tubing 10. The lower end of the cylinder may be located at or close to the lower end of the tubing 10. The size of the cylinder 14 is generally defined by its outer diameter and length. In embodiments, the outer diameter and outer shape of the cylinder may be selected to achieve the width of the annular space (or clearance) 20 formed between the cylinder 14 and the inner diameter of casing 12 to be from about 1 to about 12 mm. In embodiments, the size of the annular space may be about 1 mm, about 2 mm, about 3 mm, about 4 mm, about 5 mm, about 6 mm, about 7 mm, about 8 mm, about 9 mm, about 10 mm, about 11 mm, about 12 mm, or any size in-between.

The length of the cylinder 14 may be selected to be from about 0.1 meter to about 15 meters. In embodiments, the length of the cylinder 14 may be selected to be about 0.1 m, about 0.5 m, about 1 m, about 1.5 m, about 2 m, about 3 m, about 4 m, about 5 m, about 6 m, about 7 m, about 8 m, about 9 m, about 10 m, about 11 m, about 12 m, about 13 m, about 14 m, about 15 m or any length in-between. Specific diameters and length of the cylinder 14 may be selected to allow for the desired range of flow resistance over the lifetime of the oil well, which may be calculated using a mathematical approach described here and in my other patents cited above. In a typical case, the initial flow resistance may be selected to assure a pressure drop of about 1-3 percent of the overall bottomhole pressure. In other embodiments, the initial flow resistance is selected to assure a pressure drop of at least a few atmospheres at the upper position of the device.

Initially, the lower end of the tubing 10 and the lower end of the flow restrictor 14 may be positioned at a top position, which is defined to be at or slightly above the upper end of perforations 16—as shown in FIG. 4*a*. In this case, the flow resistance of the oil well is at a minimum as all flow from the perforations 16 may enter the tubing 10 easily—see arrows in FIG. 4*a*. This position of the flow restrictor may be used to reduce the bottomhole pressure in the well.

Figure 4B:
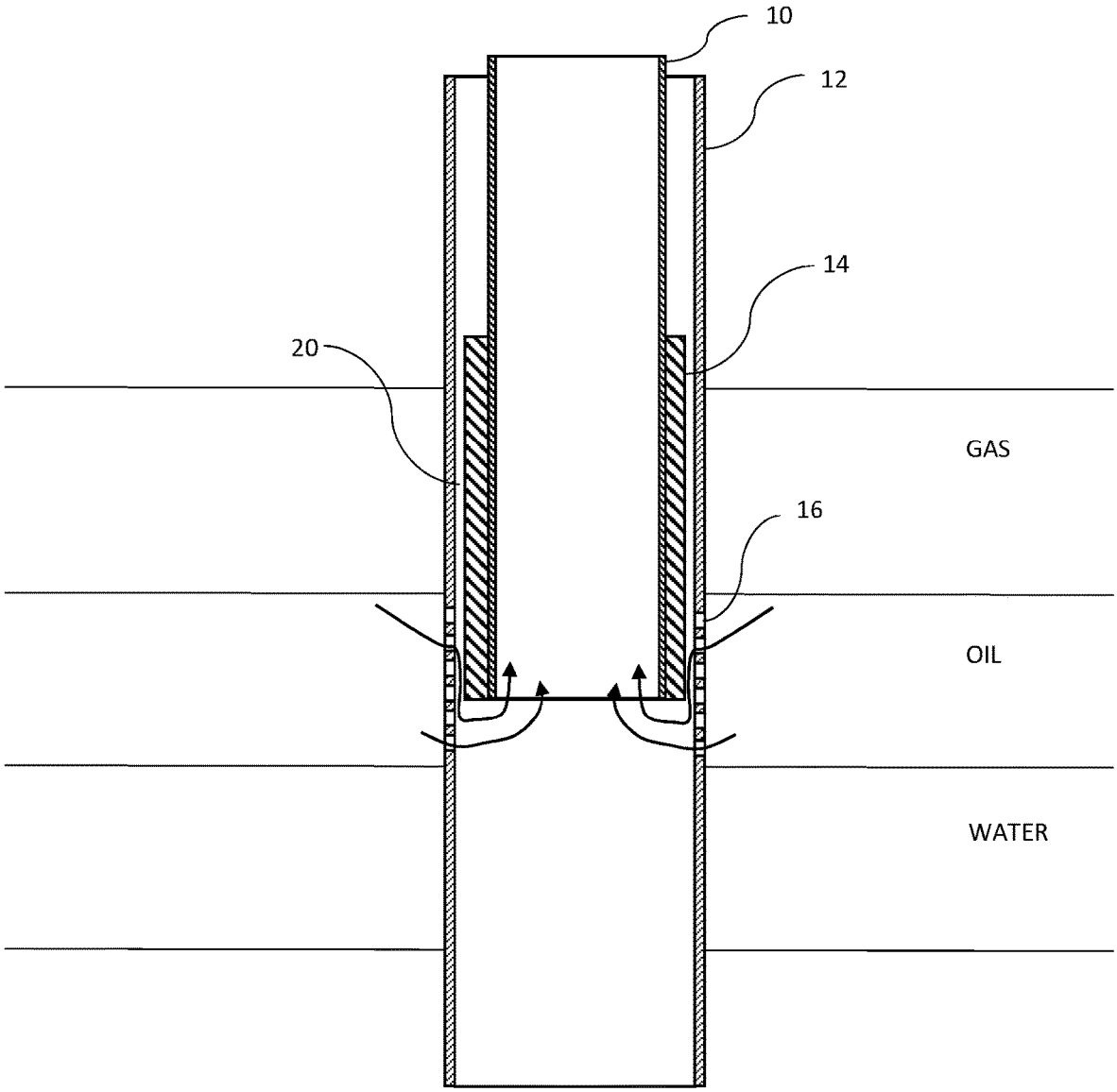
FIG. 4*b* shows the same but with a tubing lowered deeper into the oil well casing causing an increase in flow resistance so as to increase the bottomhole pressure.

FIG. 4*b* shows a position of the coaxial cylinder 14 and the tubing 10 attached to each other after the lower end of both is lowered further into the well. In this case, the flow resistance of the fluids coming into the tubing 10 through its opening at the bottom is higher than that shown in FIG. 4*a*—as at least some of the perforations 16 are located next to the outer surface of the flow restrictor 14. This forces at least some fluids to travel down the annular space 20 before entering the inside space of the tubing 10—as illustrated by arrows in the drawing.

Figure 4C:
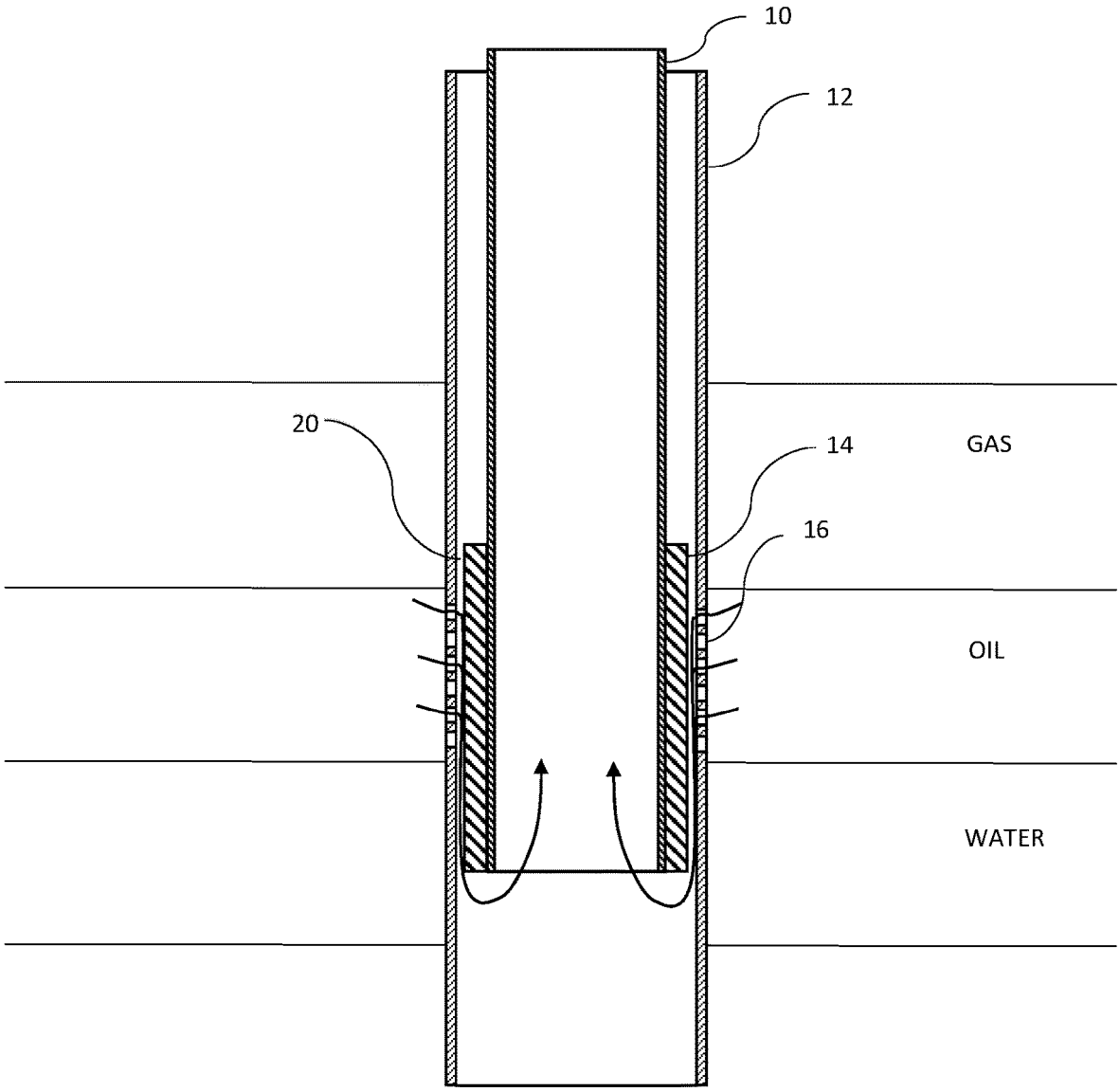
FIG. 4*c* shows a position of the flow restrictor further lowered into the oil well casing to further increase the flow resistance.

Further lowering the tubing 10 and flow restrictor 14 attached to the outside thereof is illustrated in FIG. 4*c*. In this case, all perforations 16 are facing the outer surface of the flow restrictor 14 so that all fluids from the oil layer exposed to perforations 16 are forced to travel down the annular space 20 for the distance between the lower end of perforations 16 and the lower edge of the flow restrictor 14. This length now defines the level of flow resistance and as a result the level of the bottomhole pressure in the well. To account for the flow resistance across the flow restrictor 14 in the overall mathematical model of the oil well, one can use well-known equations describing two-phase flows in a narrow channel. One example of such flow modeling in a narrow channel may be found in Brown KE and Beggs HD,

*The Technology of Artificial Lift Methods*, Vol. 1, Inflow Performance, Multiphase Flow in Pipes, the Flowing Well.

Figure 4D:
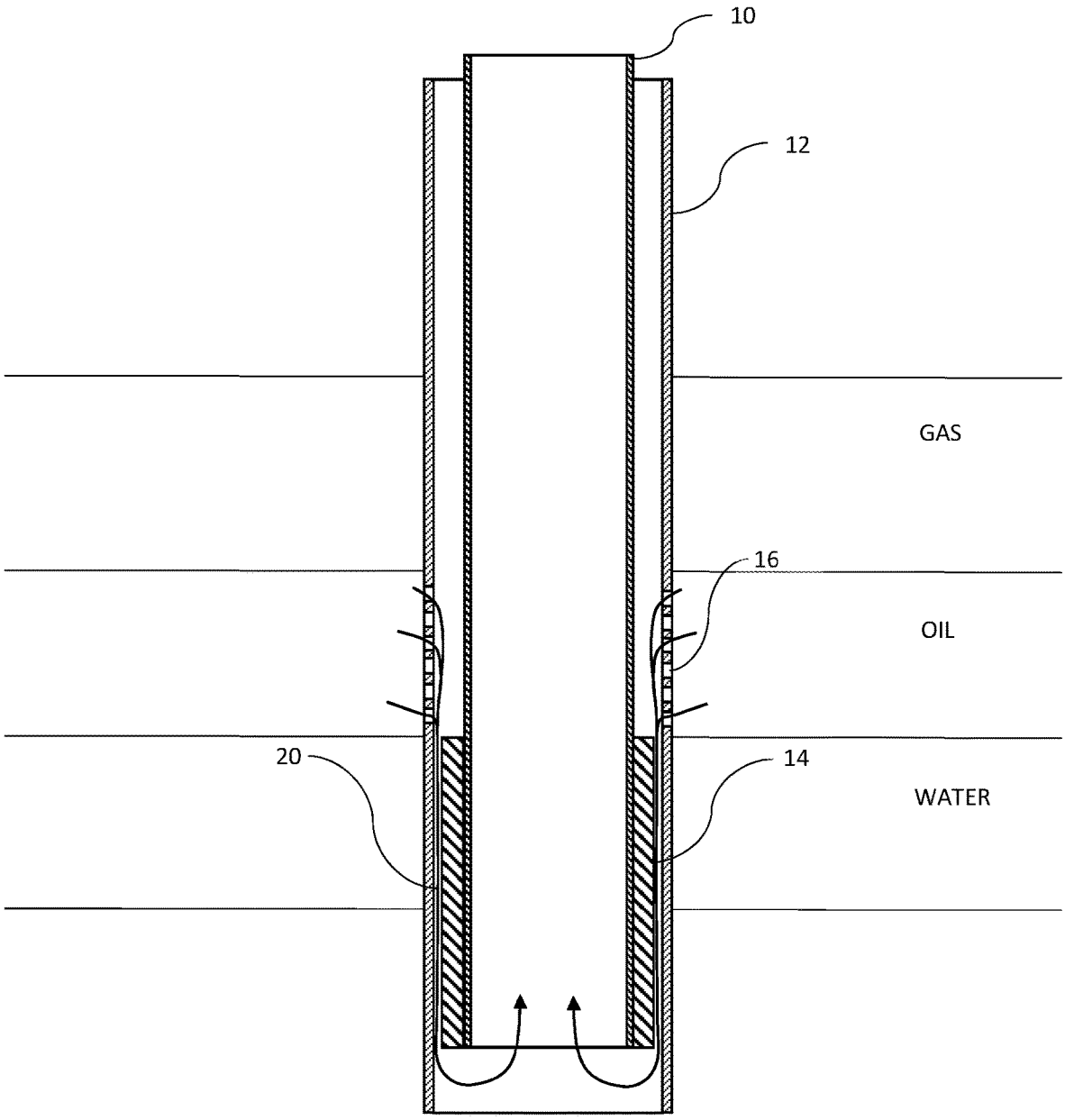
FIG. 4*d* shows a bottom position of the flow restrictor in the oil well for maximum flow resistance.

Finally, FIG. 4*d* shows the bottom position of the flow restrictor 14 where all fluid flow must travel through the longest distance of the annular space 20 as defined by the length of the cylinder 14, which in this case creates the maximum level of flow resistance of the device. In this case, the upper end of the flow restrictor is located at or slightly below the lower end of perforations 16. Further lowering of the tubing 10 may not cause any appreciable additional increase in flow resistance and therefore is not considered to be useful for affecting flow conditions at the bottom of the well.

While the cylinder 14 may or may not be located exactly in the center of the casing 12, in real-life applications the deviation of flow resistance in case of an off-center location of the cylinder 14 are not all that significant and therefore there is no need to provide additional hardware aimed at accurate centering of the cylinder 14 and the tubing 10 inside the casing 12.

The flow restrictor 14 may be made in a shape other than a coaxial cylinder so as to provide further opportunities to adjust the flow resistance by raising and lowering the tubing 10 inside the casing 12. For example, the flow restrictor 14 may contain one or more channels adapted to provide a defined geometry pathway for the fluids from the oil well and into the opening of the tubing 10 (not shown). In this case, the total flow resistance would be a combination of the flow resistance through these fixed geometry channels inside the flow restrictor 14 plus the flow resistance inside the annular space 20 between the flow restrictor 14 and the casing 12. This approach may provide for a finer adjustment of the total resistance to the fluid flow from the oil well.

In further embodiments, the flow restrictor 14 may have a slightly tapered rather than a strictly cylindrical outer surface (not shown). The taper of the outer surface of the flow restrictor 14 may be selected to have the cone of the restrictor 14 to face down—in other words, the smaller diameter of the flow restrictor 14 may be located below the larger diameter thereof. In this case, lowering of the flow restrictor 14 below the portion of the casing 12 containing perforations 16 will cause a more rapid increase in flow resistance than in case of a cylindrical shape of the flow restrictor 14 being lowered below perforations 16. In other embodiments, the shape of the cone may be reversed so that the opposite effect is achieved—lowering of the flow restrictor 14 below the plurality of perforations 16 will cause a less steep rise in flow resistance as compared with a cylindrical shape of the flow restrictor 14.

A compounded shape of the outer surface of the flow restrictor 14 is also contemplated to be within the scope of the present invention. Such shape may be developed to provide any desired rate of increase of flow resistance as a function of the length of the flow restrictor 14, which may be advantageous for certain oil wells. Examples of such compounded shape include an oval shape of the outer surface of restrictor 14, a double tapered shape (minimal diameter at the top and at the bottom with the maximum diameter in the middle), and so on.

Figure 5:
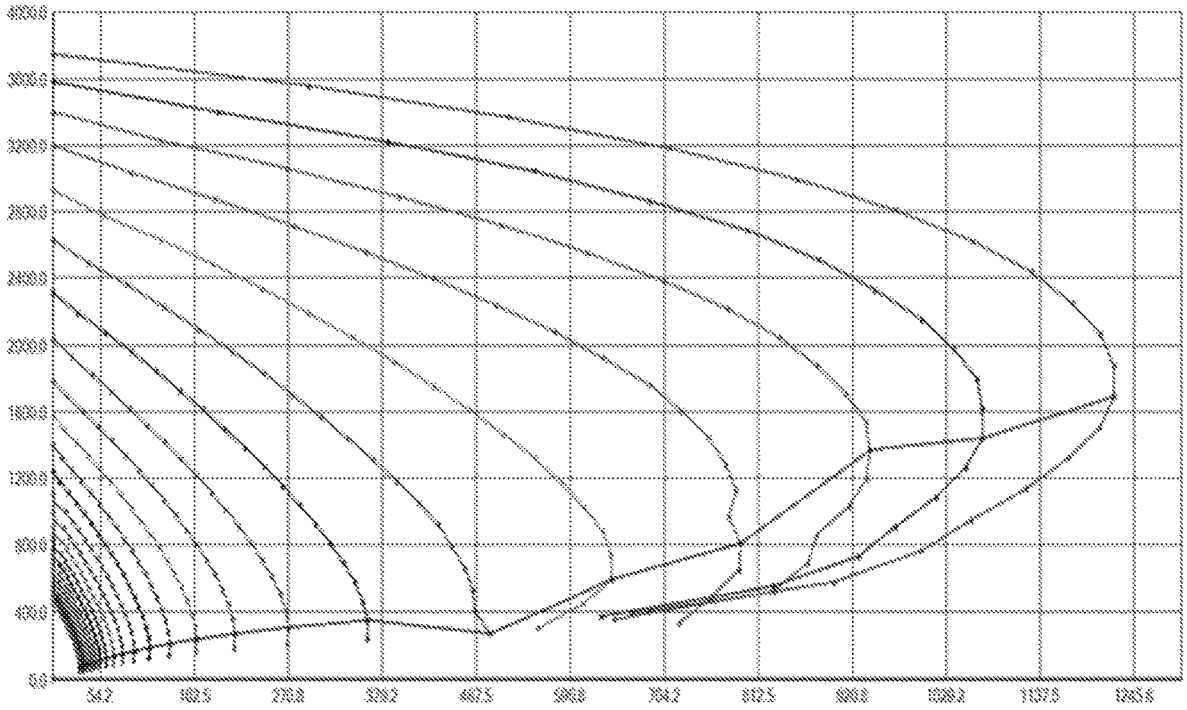
FIG. 5 is an exemplary chart showing a family of IPR curves and optimum bottomhole pressures calculated by a Reservoir Simulator for an oil well over the lifetime thereof.

FIG. 5 shows an example of a family of IPR curves calculated using my Reservoir Simulator for a single oil well over the lifetime thereof according to a calculated decline in reservoir pressure. The optimal level of maximum oil production is identified on each IPR curve. All such optimal levels of bottomhole pressure are connected by a curve shown in the drawing.

In the case of this particular chart, a comparison between the ultimate oil recovery under normal conditions was made with the circumstances of using the flow restrictor of the present invention. It was shown that the use of the invention allowed to increase the ultimate recovery index by as much as 5.9% via an increase of oil recovery by about 30,000 barrels while decreasing the production of gas by about 1.2 million cubic feet. The net economic benefit, in this case, assuming the price of oil at $60 per barrel is close to $1.8 MM for this oil well alone.

To lessen the burden of replacement of a conventional flow restrictor, the present invention provides for a simplified flow restrictor 14 in which the flow resistance can be easily adjusted by raising or lowering the tubing 10 by one or a few meters as explained below in greater detail.

According to the present invention, described is a method of adjusting the bottomhole pressure in an oil well with high GOR such as a thin oil rim gas reservoir, with the oil well including a casing extending from a surface down to and below the layer of oil in a hydrocarbon reservoir formation, and a tubing inserted generally concentrically within the casing, the method may include the following steps:

a. providing a flow restrictor attached outside a lower end of the tubing,
b. positioning the tubing with the flow restrictor such that a lower end of the flow restrictor is located at or below an upper end of perforations of the casing allowing fluid flow from reservoir formation to enter the lower end of the tubing,
c. adjusting the bottomhole pressure in the reservoir by inserting or retracting the tubing further into or out of the casing to lower or raise the lower end thereof, thereby causing the fluid to at least partially flow in an annular space formed between the flow restrictor and the casing, a length of the annular space is defined by the position of the tubing with the flow restrictor thereon inside the casing relative to perforations therein.

In embodiments, the position of the flow restrictor may be selected to be at or below a top position thereof and at or above its bottom position. The top position of the flow restrictor is defined by its lower end to be at or slightly above the upper end of perforations in the casing, which are generally made near the top of the oil layer of the reservoir formation. The bottom position is defined by the upper end of the flow restrictor being located at or slightly below the lower end of perforations in the casing, which in most cases define the bottom of the oil layer of the formation. When the flow restrictor is placed in its bottom position, all fluid flow from the reservoir must travel through the narrow annular space between the flow restrictor and the casing before entering the tubing, whereby defining maximum flow resistance and in turn causing a maximum increase in bottomhole pressure.

Figure 2:
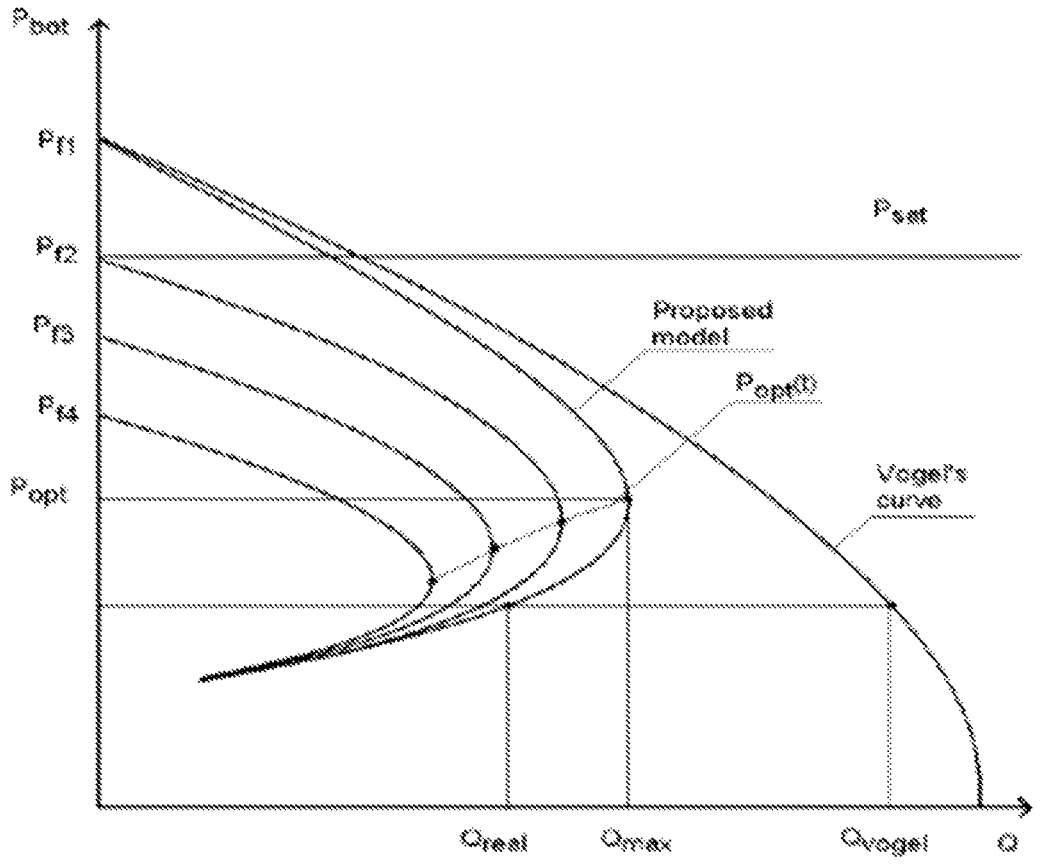
FIG. 2 is a pressure-flow chart showing a comparison of the prior art Vogel and novel proposed relationship of the bottomhole pressure and the rate of oil production.
Figure 3:
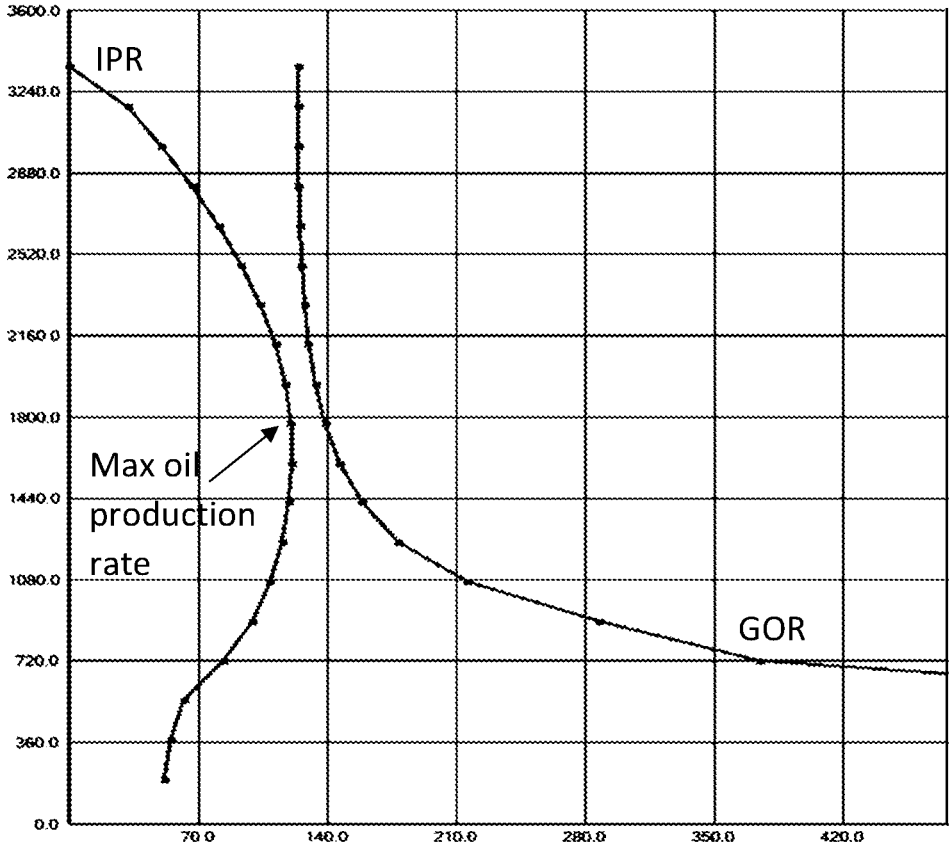
FIG. 3 shows an IPR curve overlaid with a GOR curve.

A preferred position of the flow restrictor may be selected to operate the oil well at a point of maximum oil production as illustrated in FIGS. 2 and 3. In this case, any deviations from optimal pressures and fluid flows will be self-correcting, causing the point of oil production to return to the maximum level on its own.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, Aft AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, Aft BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A flow restrictor for an oil well, said oil well comprising a casing with perforations located in a reservoir formation to allow oil to flow into said oil well, said casing further contains a production tubing movably positioned within said casing, said production tubing extending to said perforations and configured to transport fluid from said reservoir formation, said flow restrictor has a generally cylindrical shape and is attached to an outside of said production tubing within said casing, said flow restrictor defining an annular space between thereof and said casing, wherein said production tubing and said flow restrictor are positioned at or below said perforations to cause a fluid from said reservoir formation to at least partially flow through said annular space before entering said production tubing, and wherein said flow restrictor is sized to allow for said annular space to be from about 1 mm to about 12 mm in width.

2. The flow restrictor as in claim 1, wherein said flow restrictor is sized to provide a pressure drop for said fluid flowing therethrough of at least one percent of a bottomhole pressure of said reservoir formation.

3. The flow restrictor as in claim 2, wherein said flow restrictor is selected to have a length from about 0.1 meter to about 15 meters.

4. The flow restrictor as in claim 1, wherein said flow restrictor is attached to a lower end of said production tubing.

5. The flow restrictor as in claim 4, wherein said flow restrictor is attached to said production tubing to align a lower end thereof with the lower end of said production tubing.

6. A method of adjusting a bottomhole pressure in an oil well of a hydrocarbon reservoir formation, said reservoir formation comprising a layer of oil below a layer of gas, said oil well comprising a casing with perforations corresponding to said oil layer and configured to allow oil to flow through said oil well, said oil well further comprising a production tubing extending through said casing to said perforations, said method comprising the following steps:

a. providing a flow restrictor attached outside said production tubing, b. positioning said production tubing with said flow restrictor with a lower end thereof located at or below said casing perforations to allow fluid flow from said reservoir formation to enter said production tubing, c. determining said bottomhole pressure and upon detecting of said bottomhole pressure deviating from a predetermined optimal bottomhole pressure, adjusting said bottomhole pressure in the reservoir by inserting or retracting the production tubing further into or out of said casing, thereby causing the fluid to at least partially flow in an annular space formed between said flow restrictor and said casing, a length of the annular space is defined by the position of the production tubing with the flow restrictor thereon inside the casing relative to perforations in said casing.

7. The method as in claim 6, wherein said flow restrictor is positioned at or between a top position and a bottom position, said top position is defined by a lower end of said flow restrictor to be located at an upper end of said perforations of said casing, said bottom position is defined by an upper end of said flow restrictor to be positioned at or below a lower end of said perforations, in which case all fluid flow from said reservoir formation is directed to flow through said annular space outside said flow restrictor.

8. The method as in claim 7, wherein adjusting said flow restrictor is accomplished by raising or lowering said production tubing within said casing.

* * * * *